United States Patent [19]

Strongin

[11] 4,243,227

[45] Jan. 6, 1981

[54] DISC PROJECTING GAME

[76] Inventor: Ned Strongin, 936 Willow Bend La., Baldwin, N.Y. 11510

[21] Appl. No.: 76,372

[22] Filed: Sep. 17, 1979

[51] Int. Cl.[3] ..... A63F 9/02

[52] U.S. Cl. ..... 273/357; 273/126 R; 273/399; 273/241; 273/271

[58] Field of Search ..... 273/357, 399, 126 R, 273/241, 271

[56] References Cited

U.S. PATENT DOCUMENTS

| | | | |
|---|---|---|---|
| 3,002,755 | 10/1961 | Peterson | 273/357 |
| 3,108,808 | 10/1963 | Peterson | 273/357 |
| 3,797,828 | 3/1974 | Ishikawa | 273/126 R |
| 4,174,835 | 11/1979 | Breslow et al. | 273/357 |

*Primary Examiner*—Anton O. Oechsle
*Attorney, Agent, or Firm*—Edward F. Levy

[57] ABSTRACT

An action toy game comprises a flat hollow frame having an actuating lever mounted at each end and an arcuate slot extending from one lever to the other and forming a passageway for the travel of disc-shaped playing pieces propelled therethrough by manual actuation of the levers. At its central portion the arcuate slot communicates with an underlying display section of the frame, the display section being formed with a plurality of vertical compartments and having windows communicating with the vertical compartments and arranged in a square grid pattern. When each actuating lever is actuated by a player, a playing piece is propelled through the arcuate slot and drops into one of the vertical compartments where it is exposed through a window. The game pieces fill the slots until one player forms a line of game pieces according to a game plan. A second arcuate slot, which stores the game pieces, is located above the first slot and communicates with the actuating levers for feeding the game pieces individually to the actuating levers.

9 Claims, 7 Drawing Figures

FIG. 4
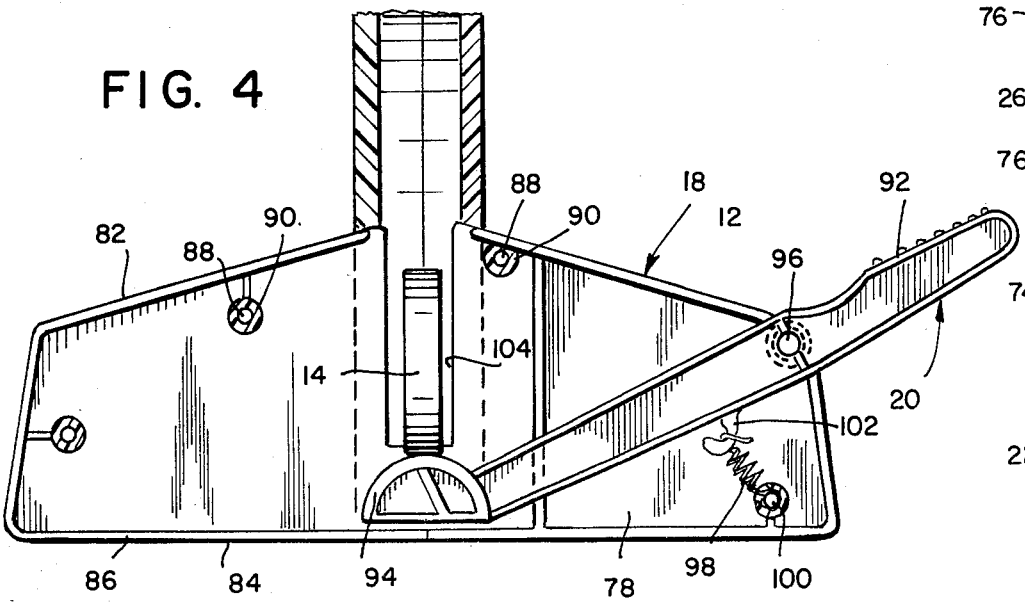
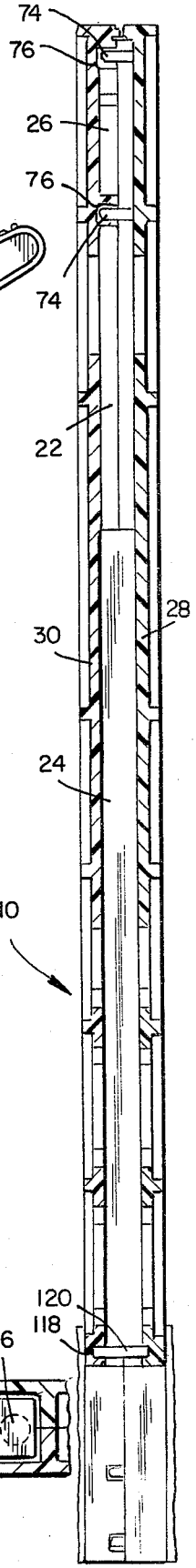
FIG. 3
FIG. 6
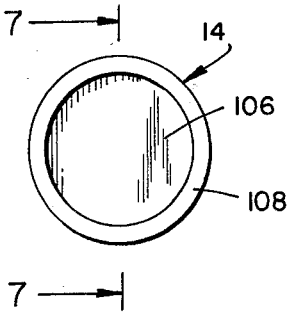
FIG. 7
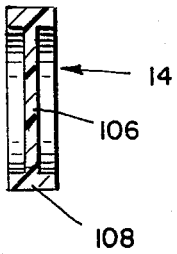
FIG. 5
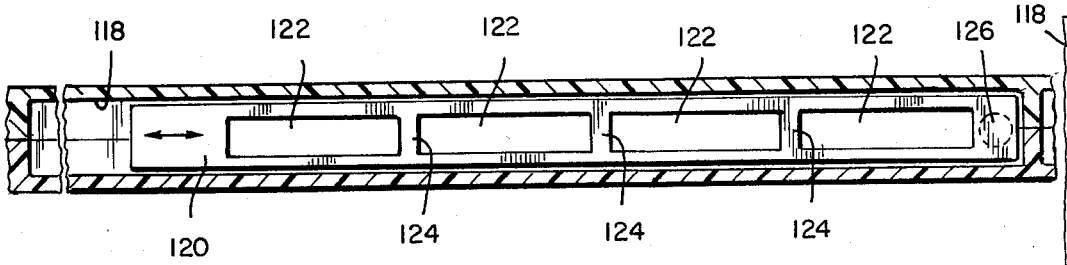

DISC PROJECTING GAME

The present invention relates to a mechanically operative action game and is particularly directed to a game requiring mechanical skill and dexterity to achieve a desirable end result.

The game as embodied in the instant invention involves the use of two players, each separately manipulating a tensioned levered mechanism to urge or drive a suitable checker-like piece along a curved path in a vertical plane to a certain elevation so as to permit the checker piece to negotiate an orifice along said path and fall therethrough under the influence of gravity into a series of vertical channel-like slots to complete the game plan. The object of the game is to propel the game pieces with a degree of skill so that they fall into the proper orifices and vertical slots and ultimately form a desired pattern therein.

The structure of the game involves the use of a semi-circular hollow frame formed of two molded plastic half-sections which are complementary and are secured together. The half-sections form therebetween a plurality of parallel arcuate slots which are concentric to each other, the outer slot serving as a storage container for the playing pieces of each player, with the playing pieces being movable under the influence of gravity to a location in which the piece overlies an actuating lever for propulsion. The inner slotted portion forms another path through which the piece is propelled and freely moves until it drops into one of the orifices along such path. Each orifice communicates with one of a series of separate vertical open channels, the channels each containing a plurality of windows or open squares so that the channels and windows in combination define a checker board-like configuration.

It is the principal object of the invention to provide a game requiring skill and exterity to achieve a desired end result.

Another object of the invention is to provide a checker-like game using dual actuating levers to sequentially drive checker-like pieces along confined passageways to and through orifices to permit the pieces to settle by gravity into slotted areas to complete a game.

Another object of the invention is to provide a game which is easily and simply constructed with inexpensive materials, easily transported and capable of being played anywhere by all age groups.

In accordance with the invention there is provided an action toy game comprising a hollow frame adapted to rest in an upright vertical position upon a support surface and having an arcuate guide slot extending from one bottom side of the frame to the other bottom side. A manually-operable actuating lever is mounted on each side of the frame at the lower end thereof, in communication with an end of said arcuate guide slot. At its central portion, the arcuate guide slot has a bottom opening communicating with a hollow frame display section mounted therebeneath, and formed with a plurality of vertical compartments. The arcuate guide slot is sized to receive circular disc-like playing pieces for sliding movement therethrough, whereby when a playing piece is set in a postion overlying the end of an actuating lever and the latter is depressed, the playing piece is propelled to the central portion of the arcuate guide slot and drops through the bottom opening thereof into one of the vertical compartments of the frame display section.

The frame is also formed with an arcuate feed slot located above said guide slot and concentric therewith. The feed slot serves as a storage channel for retaining a plurality of playing pieces and feeding them one at a time to the actuating levers. The feed slot has a top opening for inserting the playing pieces therein, and its ends terminate above the actuating members and communicate therewith.

Additional objects and advantages of the invention will become apparent during the course of the following specification when taken in connection with the accompanying drawings, in which.

Figure 1:
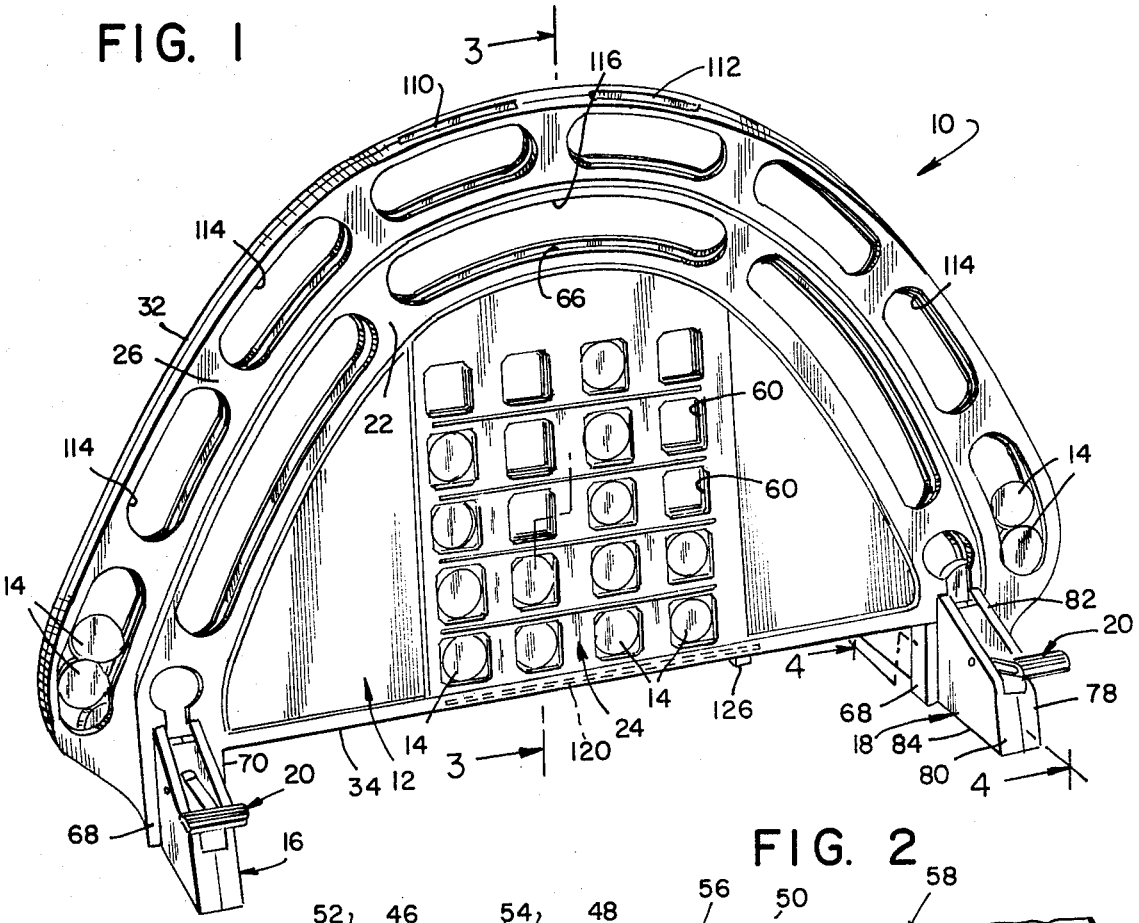
FIG. 1 is a perspective view of the action toy game of the present invention.
Figure 2:
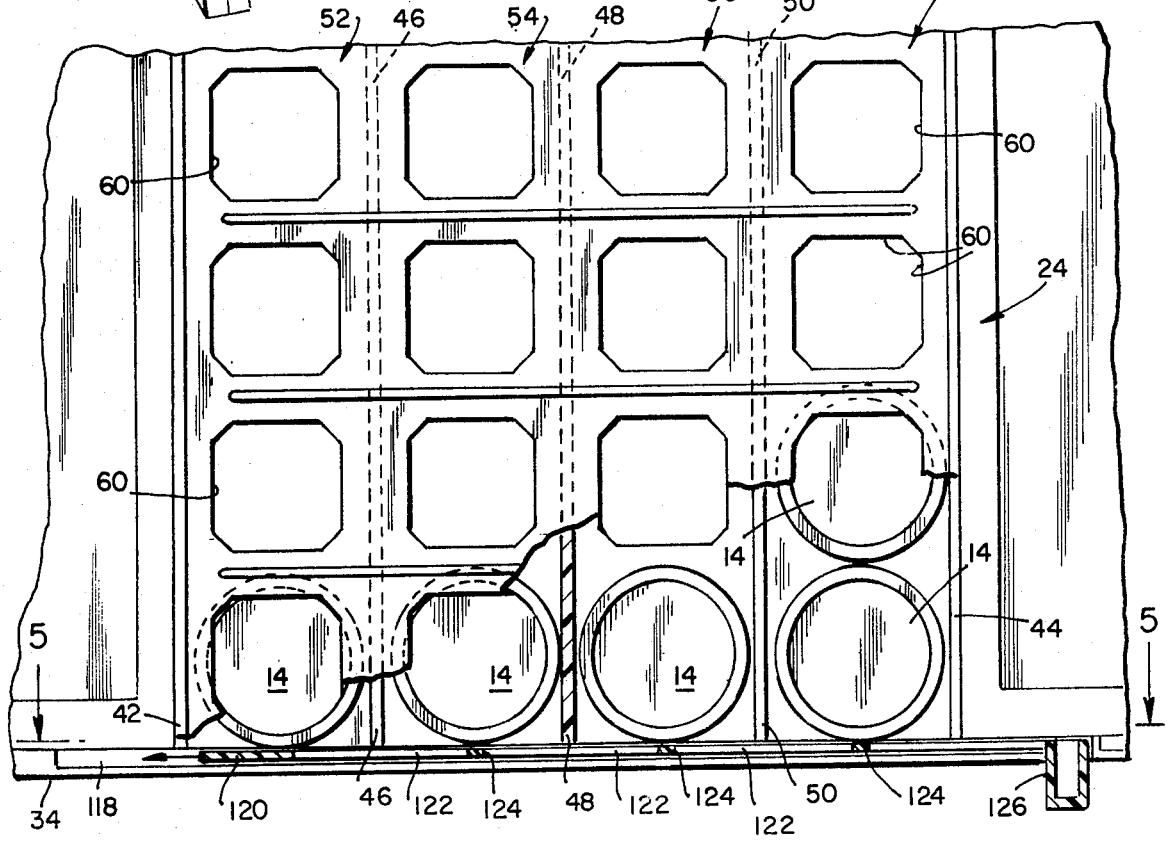
FIG. 2 is an enlarged elevational view of the display section of the frame of the game, with portions thereof broken away.
Figure 6:
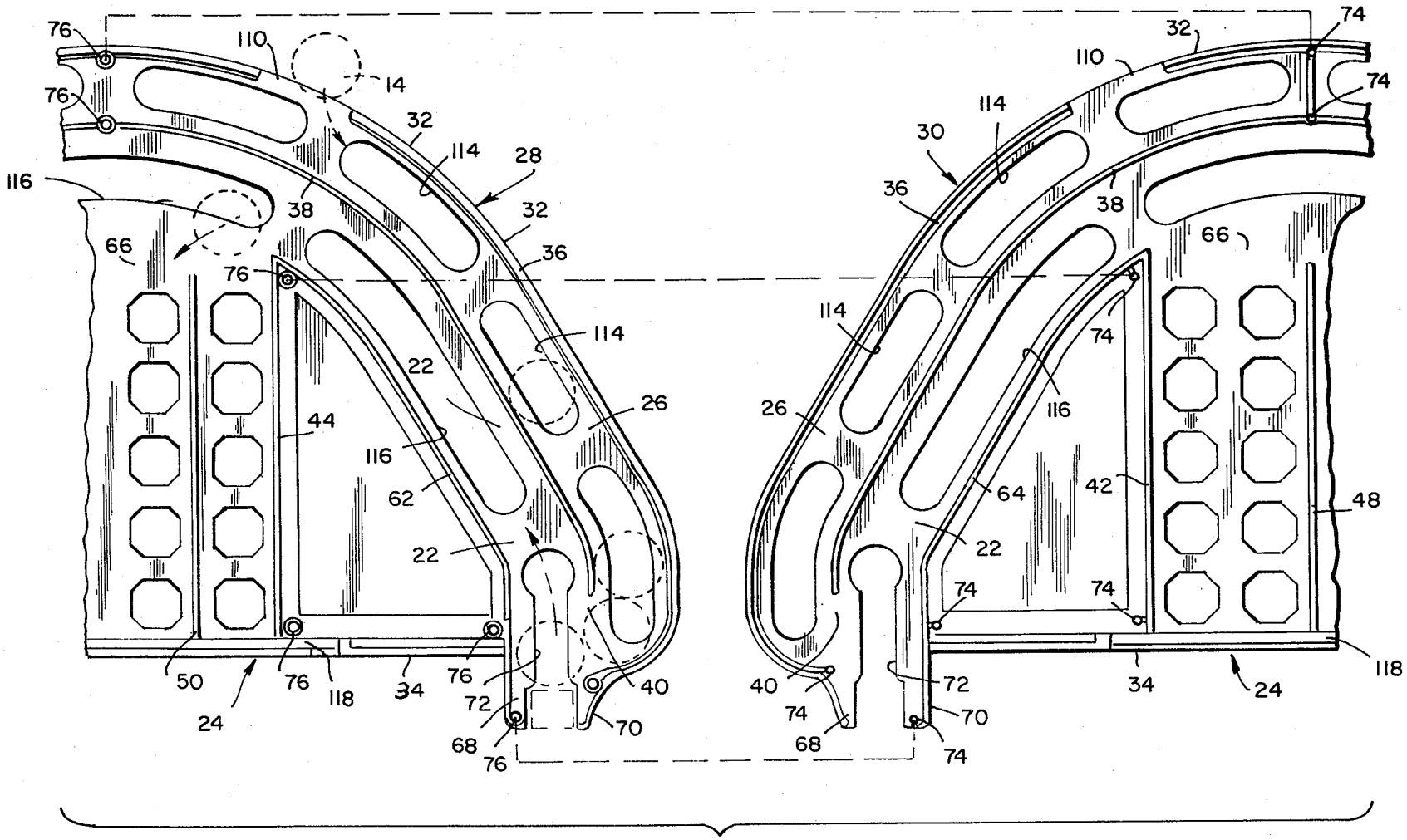

FIG. 3 a section taken along line 3—3 of FIG. 1;

FIG. 4 is a sectional view through one of the base leg members of the game, taken along line 4—4 of FIG. 1;

FIG. 5 is a sectional view taken along line 5—5 of FIG. 2;

FIG. 6 is a plan view of one of the checker-like playing pieces of the game; and FIG. 7 is a sectional view of the playing piece taken along line 7—7 of FIG. 6.

Referring in detail to the drawings, there is shown in FIG. 1 an action table game 10 made in accordance with the present invention and comprising a body frame 12 and a plurality of playing pieces 14 which are insertible into the frame 12 for playing of the game, and are removable therefrom.

The frame 12 has a narrow body of semi-circular shape having front and rear walls which are spaced a short distance from each other. The frame body is supported in elevated position above a table surface by a pair of base leg members 16 and 18, each of which mounts an actuating lever 20.

The frame 12 is formed with an arcuate channel 22 through which the playing pieces 14 are propelled individually upon selective operation of the actuating levers 20. When so propelled, at the proper velocity, the playing pieces fall from the channel 22 into vertical slots in a display section 24 of the frame. A second arcuate channel 26 is also formed in the frame 12, outwardly of the channel 22, for feeding the playing pieces 14 successively to the actuating levers, in a manner to be presently described.

In a preferred commercial embodiment of the invention, the frame 12 is molded of plastic, and for this purpose is assembled from complementary front and rear half-sections 28 and 30, shown in FIG. 8. The half-sections are identical in configuration, and are fitted and secured together to form the frame 12. Each half-section is generally semi-circular in shape having an arcuate top edge 32 and a straight bottom edge 34. The arcuate top edge 32 is bordered by an arcuate flange 36 which projects perpendicularly from the inner surface of the half-section. When the half-sections are fitted together, their arcuate flanges 36 abut each other to form a top wall in the assembled frame 12.

Each half-section 28 and 30 also has a second arcuate flange 38 which projects perpendicularly from the inner surface thereof and is spaced below the arcuate flange 36 to provide therebetween the arcuate channel 26 when the half-sections are assembled together. At each end, the arcuate flange 38 terminates short of the lower end of arcuate flange 36, to provide an aperture 40 sized to permit the passage therethrough of playing pieces 14 fed through arcuate channel 26 to the actuating levers.

At its central portion, each half-section 28 and 30 is formed with a pair of spaced vertical flanges or ribs 42 and 44 projecting perpendicularly from the inner surface thereof and defiing therebetween the display section 24. Between these vertical flanges 42, 44, the half-sections are provided with three equally-spaced intermediate vertical flanges or ribs, 46, 48 and 50, which divides the display section 24 into four vertical compartments 52, 54, 56 and 58, as best shown in FIG. 2, each compartment being sized to receive and retain a vertical row of five playing pieces 14 resting upon each other in upstanding position. Within the display section 24, the frame front and rear walls are each provided with an array of cut-out windows 60 arranged in four vertical columns and five horizontal rows. Each of the vertical columns registers with a respective vertical compartment 52, 54, 56 and 58, and the five windows therein are equally spaced from each other and positioned to register with five playing pieces 14 contained in said compartment. The twenty windows 60 are thus arranged in a checker-board pattern for observation of the playing pieces therethrough during play of the game.

The half sections 28 and 30 are each formed at each end portion with a pair of inner arcuate flanges 62 and 64, which are spaced from the intermediate arcuate flange 38 to form therebetween the arcuate channel 22 through which the playing pieces are propelled. Each flange 62 extends upwardly from the bottom edge of the respective half section to the top of the end vertical rib 44 and each flange 64 extends upwardly from the bottom edge of the half section to the top of the end vertical rib 42, as shown in FIG. 6. There is thus a wide gap 66 between the upper ends of the flanges 62 and 64, which gap overlies the top of the central display section 24. As the playing pieces are propelled through the arcuate channel 22, upon reaching the gap 66, they may fall into any of the vertical compartments 52, 54, 56 or 58 of the central display section 24.

Each frame half section 28 and 30 is formed with a pair of depending legs 68 and 70 at each of its lower outer end portions immediately below the ends of the arcuate channels 22. The legs 68 and 70 are spaced from each other to define the mouth of an elongated slot 72 which continues upwardly through the body of the frame section and partially into the channel 22 as shown in FIG. 6. The legs 68 and 70 and the slots 72 are sized to mount the base leg members 16 and 18 at the ends of the assembled body frame 12.

As shown in FIGS. 3 and 6, the frame rear half section 30 is formed with a plurality of projecting pins 74 arranged over the area of its inner surface, and the front half section 28 is formed with complementary sockets 76 sized and positioned to receive said pins when the half sections are assembled together. The pins 74 may be cemented in the sockets 76 to form the completed frame 12. The pins and sockets, as well as the projecting flanges on the half sections, serve as spacers to space apart the confronting inner surfaces of the half sections by a distance which enables the playing pieces 14, in flat position, to slide through the arcuate channels 22, 26 and the display section 24.

Each of the base leg members 16 and 18 is also formed of a pair of flat half sections 78 and 80, each having an angular top edge, 82, a flat bottom edge 84 and side edges 86 and 88, as shown in FIG. 2. The bottom edge 84 and side edges 86 and 88 are bordered by a continuous perpendicular marginal flange 90 which spaces apart the half sections when the latter are assembled together. In this assembled condition, the base leg member is closed off at its bottom and sides by the abutting flanges 90, as shown in FIG. 1, but is open at its top. The half-sections 78 and 80 are secured together by pins 88 which are cemented within matching sockets 90.

Pivotally mounted within each base leg member 16 and 18, between the spaced half-sections thereof, is an actuating lever 20. As shown in FIG. 4, the actuating lever 20 has at one end a handle portion 92 which projects outwardly of the base leg member, and at its other end a propelling head 94. The propelling head 94 serves to engage and project an overlying playing piece 14 upwardly through the arcuate channel 22, and for this purpose is made of semi-circular shape to provide a smooth impacting action upon the playing piece. Intermediate the handle portion 92 and propelling head 94, the actuating lever is pivotally mounted on the base leg member 16 or 18 by a pivot pin 96 which extends between the base member half sections 78 and 80. The actuating lever 20 is normally biased to the lowered position shown in FIG. 4, with the propelling head 94 resting upon the bottom wall of the base leg member, by a coil spring 98 which is anchored at one end on a member 100 affixed to the body of base leg member and is connected at its other end to a hook 102 formed on the lever 20 and depending therefrom.

Each base leg member 16 and 18 is formed with an elongated rectangular vertical slot 104 which extends downwardly from the center of the top edge of each half section 78 and 80, as shown in FIG. 4. The base leg members 16 and 18 are each of such width that they may be inserted to a mounted position within the respective slots 72 at each side of the body frame 12, and between the depending legs 68 and 70, wherein the base leg members are frictionally retained in mounted position. The base leg members may, however, be easily removed when the game is not in use for storage of the game in a compact condition within a flat box.

In their mounted positions, the base leg members 16 and 18, extend perpendicularly of the body frame 12, as shown in FIGS. 1 and 4, and support the latter immovably in upright position upon a table surface. In this mounted position, the propelling head 94 of each actuating lever is located within one of the slots 72 in the base frame, which slots provide clearance for movement of the propelling heads. The slot 104 in each base leg member 16 and 18 terminates a short distance above the propelling head 94, as shown in FIG. 4, and provides a passage through which a playing piece 14 in the adjacent end of the arcuate feed channel 26 is fed by gravity to a position in which it rests centrally upon the propelling head 94.

Each playing piece 14, as shown in FIGS.6 and 7, is circular in shape having a flat disc-like body 106 and a wide peripheral rim or circumferential flange 108 which provides a large surface area around the playing piece and provides a wide line of contact with the arcuate upper surface of the actuating lever propelling head 94. Thus a sharp and consistently even force is applied to each playing piece when the actuating lever is depressed. Each player is provided with a plurality of playing pieces 14, in the preferred embodiment shown, each player having ten playing pieces. The playing pieces of each player are distinguished by being of different colors, for example, one player having red pieces and the other blue pieces.

The arcuate top edge 32 of the body frame 12 is provided with a pair of spaced apertures 110 and 112 sized to permit a playing piece 14 to be inserted therethrough into the upper arcuate channel 26. The apertures 110 and 112 are located on either side of the central apex of the arcuate top edge 32. Thus, to initiate the game, one player inserts his ten playing pieces, one at a time, through the aperture 110 so that these playing pieces will fall into the left-hand side of the upper arcuate channel 26, as viewed in FIG. 1, and will be retained therein in an edgewise stack above the actuating lever 20 of base leg member 16. The other player deposits his ten playing pieces 14 of contrasting color through aperture 12 into the right-hand side of upper arcuate channel 26, with these playing pieces forming an edgewise stack therein above the actuating lever of base leg member 18.

When the playing pieces are inserted in their stacked condition, as described above, the lowermost playing piece in each stack passes through the aperture 40 at the lower end of channel 26, as shown in FIG. 6, and through the registering slot 104 in the base leg member, and comes to rest upon the arcuate top surface of the propelling head 94 of the corresponding actuating lever, in which position the playing piece is ready to be propelled by depression of the actuating lever.

In play of the game, each player first inserts his ten colored playing pieces 14 through the top slot 110 or 112 closest to the base leg member 16 or 18 at which the player is positioned. Each player's playing pieces are thus stacked and stored in the upper arcuate channel 26, with the lowermost playing piece of the stack resting upon the propelling head 94 of the lever in the base leg at the player's position. The player having the first turn initiates the game play by striking sharply downward upon the handle portion 92 of his actuating lever 20, causing the lever to impel the playing piece upwardly through the lower arcuate channel 22. If the playing piece is propelled with the proper force, it will lose momentum at the central portion of the arcuate channel 22 and fall through the gap 66 into one of the vertical compartments 52, 54, 56 or 58 of the display section 28. The other player then takes his turn by sharply depressing the handle portion of his actuating lever 20, causing the lowermost playing piece in his stack to be propelled into one of the said vertical compartments of the display section 28. As each playing piece is propelled by an actuating lever 20, and the latter is biased back to its lowered retracted position, the next playing piece in the stack automatically falls by gravity to an operative position resting upon the propelling head 94 of the retracted actuating lever.

As each player propels a playing piece by striking sharply downwardly upon his actuating lever, the playing piece slides along the arcuate channel 22 until it loses momentum, at which time it drops by gravity through the gap 66 and into and into an underlying vertical compartment 52, 54, 56, or 58. The front and rear walls of the body frame 12 are provided with elongated apertures or windows 114 which register with outer arcuate channel 26 so that the playing pieces stored therein may be observed. The frame front and rear walls are also provided with similar elongated apertures or windows 116 which register with the inner arcuate channel 22, and through which the travel of the propelled playing pieces may be observed. It will be apparent that a degree of skill is required during play in order to propel the playing pieces with the force required to cause them to fall into selected vertical compartments so as to form a winning pattern.

Play continues in this manner, with each player alternately operating his actuating lever so that the playing pieces form vertical rows in each of the vertical compartments 52, 54, 56 and 58. Each of the playing pieces is visible through one of the registering windows 60. The game is continued until one player succeeds in propelling his playing pieces to a position in which a vertical, horizontal or diagonal row of playing pieces of his color are formed in the display section 24 and are visible through the windows 60. This player becomes the winner of the game, and a new game can be begun.

After a game is completed, it is necessary to remove the playing pieces from the display section 24 in order to commence a new game. For this purpose, the bottom wall of the body frame 12 is provided with an elongated slot 118 which underlies the display section 24 and communicates with the follow interior thereof. Slidably mounted within the slot 118 is a retaining member 120 having a plurality of rectangular apertures 122 separated by narrow cross-pieces 124, as shown in FIG. 5. The retaining member 120 has a normal position, shown in FIGS. 1 and 2, in which cross-pieces 124 are centrally located beneath each of the respective vertical compartments 52, 54, 56 and 58 and block the bottom ends of said compartments to retain the stacks of playing pieces 14 therein during play of the game. After completion of the game, the retaining member 120 may be manually slid to a release position in which its rectangular apertures 122 register with the bottom ends of said vertical compartments, thereby permitting the stacks of playing pieces to drop out through said rectangular apertures 122. To permit easy manipulation of the retaining member 120 in sliding it between its normal and release positions, the retaining member is formed with a depending finger piece 126.

While a preferred embodiment of the invention has been shown and described herein, it is obvious that numerous omissions, charges and additions may be made in such embodiment without departing from the spirit and scope of invention.

What is claimed is:

1. An action toy game conprising a hollow frame adapted to rest in an upright vertical position on a support surface, an upwardly-arched arcuate guide channel formed in said frame and extending from one bottom side of the frame to the other bottom side thereof, a pair of manually-operable actuating levers respectively mounted at each side of said frame at the lower end thereof in communication with the ends of said arcuate guide slot, a hollow display section formed in said frame at the central portion thereof, beneath said arcuate guide channel, said display section being divided into a plurality of vertical compartments, the bottom wall of said arcuate guide channel having an elongated gap extending the width of said display section and communicating therewith, and a plurality of disc-like playing pieces each sized for insertion within said frame to a position within one end of said arcuate guide channel overlying the adjacent actuating lever, said playing pieces being also sized for sliding movement within said guide channel, whereby when said actuating lever is depressed, the playing piece is propelled through the guide channel and falls through said gap into one of the vertical components of said display section.

2. An action toy game according to claim 1 in which said frame is also formed with an arcuate feed slot located above said guide slot and concentric therewith, the ends of said feed slot communicating with the end portions of said guide slot and with the respective actuating levers.

3. An action toy according to claim 2 which said frame is formed with a pair of apertures communicating with opposite sides of said arcuate feed channel, and sized for insertion of said playing pieces therein, with said playing pieces forming an edgewise stack within the sides of said arcuate feed channel, and with the lowermost playing piece in each stack moving by gravity to the adjacent bottom end of said arcuate guide slot and overlying the actuating lever therein.

4. An action toy according to claim 1 which also includes a pair of base leg levers, each pivotally mounting one of said actuating member, and means for removably mounting said base leg members at the lower end portions of said frame, with said actuating levers communicating with the ends of said arcuate guide slot.

5. An action toy according to claim 4 in which each actuating lever has at one end a handle portion projecting from said base leg member, and at the other end a semi-circular propelling head, each base leg member including biasing means urging said actuating lever to a normal position in which said handle portion is elevated and said propelling head is lowered and in communication with the bottom end of said arcuate guide channel.

6. An action toy according to claim 1 in which said display section is provided with a plurality of windows communicating with the vertical compartments therein, said windows being arranged in spaced linear vertical and horizontal rows.

7. An action toy according to claim 6 in which said windows are arranged in five horizontal rows and four vertical rows.

8. An action toy game according to claim 1 in which said frame is formed of two complementary half-sections molded of plastic material, each of said half-sections being formed with flanges defining said arcuate guide and feed channels and said vertical compartments in said display section.

9. An action toy game according to claim 1 in which said frame has a bottom wall formed with an elongated slot underlying said display section and a retaining member slidably mounted in said slot and movable between a retaining position in which it covers over the bottom ends of said vertical compartments, and a release position in which it uncovers the bottom ends of said vertical compartments.

* * * * *